United States Patent [19]

Wehrle et al.

[11] Patent Number: 5,053,756

[45] Date of Patent: Oct. 1, 1991

[54] ELECTROMAGNETIC RELAY WITH RETURN SPRING

[76] Inventors: Gerhard Wehrle, Waldstrasse 26, D-7710 Donaueschingen; Ursula Seitz, Vorstadtstrasse 17, D-7209 Wehingen; Karl Blaschi, Sommerain 49, 7209 Wehingen, all of Fed. Rep. of Germany

[21] Appl. No.: 630,214

[22] Filed: Dec. 18, 1990

[30] Foreign Application Priority Data

Dec. 21, 1989 [DE] Fed. Rep. of Germany ..... 3942340

[51] Int. Cl.[5] ..... H01H 67/02

[52] U.S. Cl. ..... 335/274; 335/129; 335/274

[58] Field of Search ..... 335/127, 128, 129, 192, 335/274

[56] References Cited

U.S. PATENT DOCUMENTS 4,706,056 11/1987 McCullough ..... 335/274 X 4,818,965 4/1989 Hinrichs et al. ..... 335/274

*Primary Examiner*—George Harris

*Attorney, Agent, or Firm*—Brown, Martin Haller & McClain

[57] ABSTRACT

An electromagnetic relay with a return spring is described, where the relay consists of a solenoid coil with a movable armature as the drive and a contact spring assembly, and there is an actuating rod that starts from one end of the armature and engages with spiral springs by means of catches for actuation of the contact, whereby the return spring at the other end of the actuating rod returns the contact spring assembly to home position.

In order to achieve a significant reduction in force with the contact spring assembly in actuating the relay, the reset spring here is designed as a top dead center spring such that when the relay is driven against the return spring, the force needed to bend the spring is reduced.

4 Claims, 1 Drawing Sheet

ELECTROMAGNETIC RELAY WITH RETURN SPRING

This invention concerns an electromagnetic: relay with a return spring, where the relay consists of a solenoid coil with a movable armature as the drive and a contact spring assembly, and at one end of the armature there is an actuating rod that engages spiral springs by catches for actuating the contact, and the return spring at the other end of the actuating rod restores the contact spring assembly to home position.

Such electromagnetic relays with a return spring are used in many areas of technology, but the return springs used in the past have been normal leaf springs. When a leaf spring is used as a return spring that acts on the actuating rod, however, this leads to the disadvantage that the spring develops an undesirable force demand due to the deflection created by the drive. This results in an unfavorable load characteristic because the force demand of the return spring, which is due to the armature drive and is essentially unnecessary here, must be overcome.

The purpose of the present invention is therefore to further refine the design of an electromagnetic relay with a return spring of the aforementioned type so as to yield a significant reduction in force with the return spring in the area of the drive by the armature in actuation of the contact spring assembly by the actuating rod.

To solve this problem, this invention proposes a return spring design which permits a reduction in the force needed to bend the return spring when the relay is driven against it.

The nature of this invention is thus that when the actuating rod is first deflected by the armature, the return spring is also deflected such that the restoring force of the return spring initially declines.

The return spring in conjunction with the actuating rod is connected in parallel with the spiral springs of the contact spring assembly, where the movable contact is located on the spiral springs. This yields a characteristic which permits a significant reduction in force in comparison with a traditional leaf spring type of return spring.

The contact spring assembly without the return spring has no bias, i.e., it is in a neutral position where all the contacts are open.

According to this invention, the resting position of the contacts is now created by means of the return spring in a top dead center arrangement. Therefore, when the contact spring assembly is deflected into a working position, only a diminishing force need be applied by the armature as the drive.

In conjunction with the restoring force of the return spring, which is designed here as a second drive in comparison with the armature, this yields the effect that a force which is initially almost constant must be applied at the start of deflection in parallel to the characteristic of the contact spring assembly, and the force that must be expended by the armature increases only with a greater deflection.

On the whole, the required force is reduced with the design of the return spring according to this invention because the force to be applied by the armature at the start of deflection of the contact spring assembly or the return spring decreases only with regard to the return spring.

In an advantageous version, the return spring has a characteristic such that the greatest restoring force occurs at its greatest deflection.

The return spring here is arranged in a recess in the spring bracket, preferably under a bias tension with a forward curvature.

In one version an adjusting device, e.g., an adjusting screw, a wedge, etc., is provided in the spring bracket to adjust the bias of the return spring.

This invention will now be described on the basis of a practical example with figures, and additional advantages and features of this invention will be apparent from the following specifications.

FIG. 1 shows an electromagnetic relay with guided contacts, where a return spring 3 is needed for the bias of the contact spring assembly 4 in the overall operation of the relay.

Figure 2:
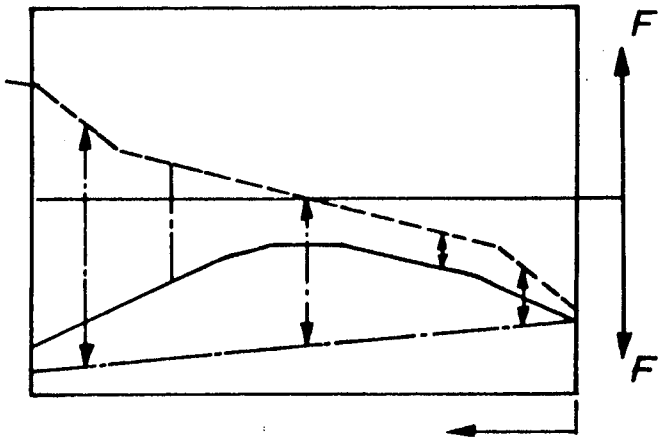
FIG. 2 shows a force-strain diagram for the contact spring assembly and the return spring in comparison with a known leaf spring.

The relay itself is a known design consisting of a solenoid coil 1 with a movable armature 5 as the first drive and a contact spring assembly 4 with an actuating rod at one end of armature 5 engaging spiral springs 7 by means of catches for actuation of the contact. Return spring 3 is arranged at the other end of actuating rod 2 and returns the contact spring assembly 4 with the spiral springs 7 to home position in the manner of another drive.

Return spring 3 according to FIG. 1 is designed as a top dead center spring, which yields a very advantageous change in the load characteristic here.

Figure 1:
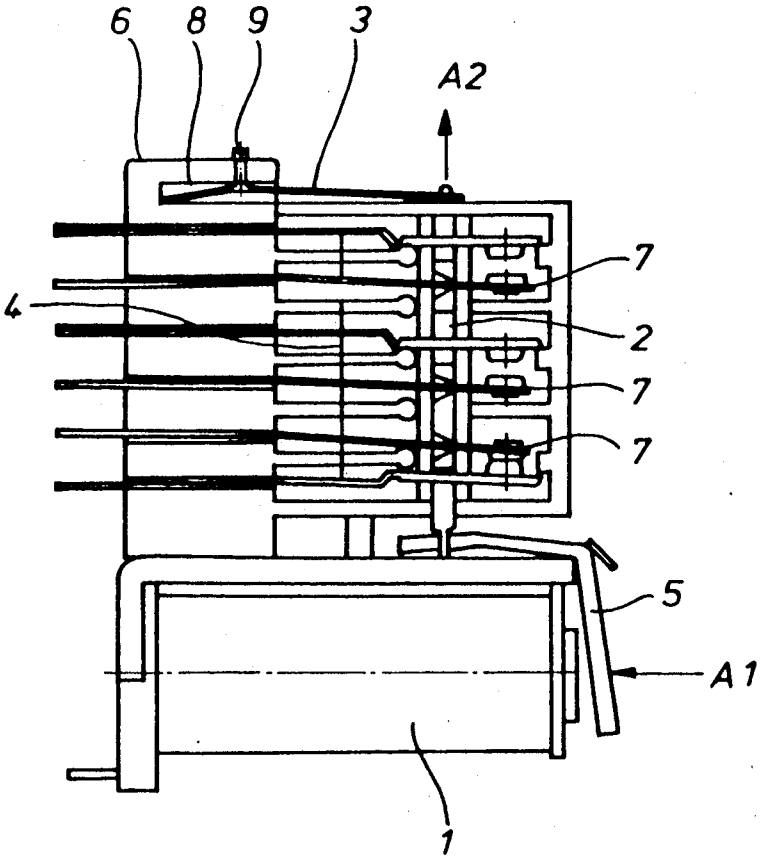
FIG. 1 shows an electromagnetic relay with the return spring according to this invention.

FIG. 1 shows a force-strain diagram, where curve 1 shows the force curve of spring assembly 4 with regard to this deflection.

FIG. 2 shows that spring assembly 4 is first under a bias and then as deflection progresses it enters a neutral range from which a greater force must be exerted with any further deflection.

Curve 2.1 in FIG. 2 represents a force-strain diagram of a traditional return spring, especially a leaf spring, which shows that a steadily increasing force must be applied via the armature starting from the initial deflection in order to deflect such a traditional return spring.

Curve 2.2 in FIG. 2 shows the force-strain diagram of return spring 3 according to FIG. 1 using a degressive spring or a top-dead-center type of spring. It is apparent here that first the force required to deflect the spring decreases when starting from home position. Only beyond the range of a certain deflection does the force exerted on return spring 3 to deflect it increase again in the desired way, and the greatest restoring force is achieved in the area of the greatest deflection in order to reset the contact spring assembly 4 including actuating rod 2 and armature 5.

Figure 3:
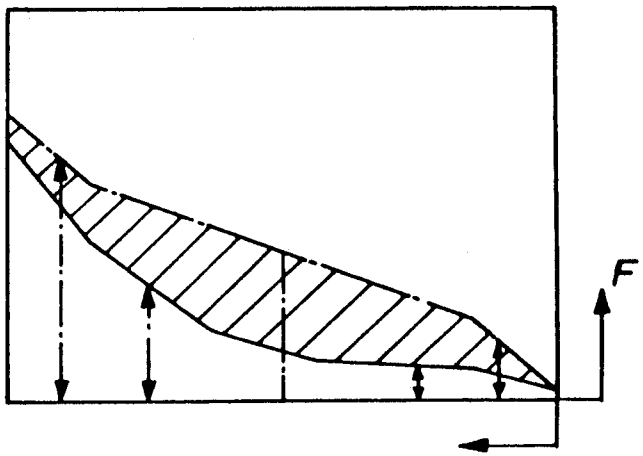
FIG. 3 shows a diagram of the force expended in actuation of the relay with the return spring according to this invention in comparison with a traditional return spring.

FIG. 3 shows a diagram for the force expended and the force saved when using a traditional return spring versus a degressive return spring 3 according to Figure where curve 1.1 is a cumulative curve representing the addition of the force-strain diagram 1 and curve 2.1 of a traditional return spring according to FIG. 2.

Curve 1.2 in FIG. 3 shows the force expended when using a degressive return spring 3 in conjunction with a spring assembly 4 according to the sum of curves 1 and 2.2 according to FIG. 2.

FIG. 3 shows that with curve 1.1 which is based on a normal leaf spring, a substantial force must be expended by the armature drive due to the nature of the traditional leaf spring in order to deflect the contact spring assembly including the reset spring.

By comparison, curve 1.2 in FIG. 3 shows that when using a degressive return spring 3 according to FIG. 1 with a spring assembly 4, a much lower force must be expended in order to assure the same deflection (the dotted lines indicate the force savings achieved in this way).

In conjunction with the force saved, a relay is actuated with contact spring assembly 4 and a great deal of force is saved in deflection of spiral spring 7 without having to sacrifice any other properties of the contact spring assembly.

FIG. 1 also shows that reset spring 3 is arranged in a recess 8 of spring bracket 6 under a bias tension, whereby an adjusting screw 9 is provided to adjust the bias. Rod 2 starts at one end of armature 5 and extends through an armature borehole and then also passes through spiral springs 7 with the help of catches and the other end of rod 2 is in contact with top-dead-center spring 3.

The practical example according to FIG. 1 with the arrangement of the contact spring assembly 4 in a spring bracket 6 is by no means restrictive when used with the degressive return spring 3, but instead the special return spring 3 can also be used with other types of contact spring assemblies in magnetic systems.

We claim:

1. Electromagnetic relay with a return spring, where the relay consists of a solenoid coil with a movable armature as the drive and a contact spring assembly, and an actuating rod is attached at one end of the armature and engages with spiral springs by means of catches for actuation of the contact, such that the return spring at the other end of the actuating rod returns the contact spring assembly to home position, characterized in that return spring (3) is designed as a top-dead-center spring such that the force needed to bend the return spring (3) decreases when the relay is driven against the spring.

2. Relay according to claim 1, characterized in that return spring (3) has a spring characteristic such that the greatest restoring force occurs at its greatest deflection.

3. Relay according to claim 1, characterized in that return spring 3 is arranged in a recess 8 in the spring bracket (6) under a bias tension with a forward curvature.

4. Relay according to claim 3, characterized in that an adjusting device (9), is arranged in the spring bracket (6) to adjust the bias of the return spring (3).

* * * * *